US006098835A

United States Patent [19]

DeJonge

[11] Patent Number: 6,098,835

[45] Date of Patent: Aug. 8, 2000

[54] CHILD RESISTANT PILL ROTATING DISK DISPENSER

[75] Inventor: Stuart W. DeJonge, Easton, Pa.

[73] Assignee: Valley Design Inc., Bloomsbury, N.J.

[21] Appl. No.: 09/150,649

[22] Filed: Sep. 3, 1998

[51] Int. Cl.[7] ..... G07F 11/66

[52] U.S. Cl. ..... 221/25; 221/88; 206/531

[58] Field of Search ..... 221/25, 26, 30, 221/2, 5, 7, 9, 15, 86, 88, 82; 206/531, 534

[56] References Cited

U.S. PATENT DOCUMENTS

| | | | |
|---|---|---|---|
| 3,279,651 | 10/1966 | Thompson | 221/88 |
| 4,165,709 | 8/1979 | Studer | 116/308 |
| 4,298,125 | 11/1981 | Berghahn | 206/531 |
| 4,778,054 | 10/1988 | Newell | 206/531 |
| 5,409,132 | 4/1995 | Kooijmans | 221/86 |
| 5,464,118 | 11/1995 | Grau | 221/5 |
| 5,562,231 | 10/1996 | Lambelet, Jr. | 221/5 |
| 5,570,810 | 11/1996 | Lambelet, Jr. | 221/86 |
| 5,664,697 | 9/1997 | Lambelet, Jr. | 221/5 |

*Primary Examiner*—Kenneth W. Noland
*Attorney, Agent, or Firm*—Kenneth P. Glynn, Esq.

[57] ABSTRACT

The present invention is a child resistant rotating disk pill dispenser with a main housing to receive a circular pill package and pill package tray for rotation. The tray contains annularly arranged pill-drop orifices, and hold in place a circular pill package with a plurality of pills arranged to coincide with the pill-drop orifices. The tray has ratchets for engagement with a rotating knob for advancement thereof and the knob is connected to a said main housing central shaft so as to be selectively rotatable and reciprocally movable, with a first vertical position upwardly relative to the pill package tray and a second vertical position downwardly toward the pill package tray. When the knob is in its first vertical position, it is not in rotatable engagement with the ratchets, and when it is in its second vertical position it is in rotatable engagement therewith. A plunger is included for pushing pills through a pill package, through a pill-drop orifice and out the dispensing orifice.

20 Claims, 4 Drawing Sheets

CHILD RESISTANT PILL ROTATING DISK DISPENSER

BACKGROUND OF THE INVENTION

1. Field of the Invention

The present invention involves pill dispensers for rotating pill disks or pill packages, and, more particularly, child resistant dispensers for use with pill packages such as blister pack disks.

2. Information Disclosure Statement

The following prior Art Patents illustrate the state of the art for pill dispensers with disks.

U.S. Pat. No. 3,279,651 to Gordon J. Thompson, describes a dispenser for use with a pill sandwiched between a flexible sheet and a rupturable sheet bonded together about the pill to define a sealed enclosure therefore, a generally planar wall having an opening therein slightly larger than the pill, means for holding said sealed enclosure with said rupturable sheet against said wall and with the pill aligned with said opening, manually actuatable means movable in a plane parallel to said wall, and wedge means carried by said surface engageable with said flexible sheet for pressing the pill through said opening and through said rupturable sheet.

U.S. Pat. No. 4,165,709 to John E. Studer, describes a tablet dispensing device which comprises a substantially flat support having a single tablet dispensing aperture therein. A tray is adapted to rotate on one surface of the support and has a plurality of openings therein disposed in a circular orientation. The openings are arranged to individually align in registration with the aperture upon rotation of the tray. The tray is adapted to receive a tablet dispensing package containing a plurality of tablets. A tablet is dispensed by pressing it from the package through its corresponding opening in the tray sequentially places each opening over the aperture in alignment therewith so that the remaining tablets can be individually dispensed.

U.S. Pat. No. 4,298,125 to Walter G. Berghahn and Jack Weinstein, describes a child resistant dispensing package for tablets and the like of the dial type provided with a dispenser opening in the upper section; the lower section is provided with a plurality of flexible tablet pockets that are covered over with a sheet of rupturable material (e.g. aluminum foil); the upper and lower sections are provided with location indicators to line the tablet pockets up with the dispenser opening; tablets are dispensed by pushing the tablet pockets with enough force to rupture the sheet material.

U.S. Pat. No. 4,778,054 to Robert E. Newell and Robert A. Fitzsimmons, describes a pack with a circular carrier disc provided with a plurality of containers arranged in a circle and each containing a dose of medicament in particulate form. The containers are puncturable to permit the medicament therein to be released.

U.S. Pat. No. 5,409,132 to Kees Kooijmans and Alfred H. Van Elk, describes a tablet dispenser, including a dispenser housing, a replaceable tablet package to be accommodated in the housing, an adjustable periodicity indicator and a single tablet dispensing aperture in the dispenser cover. The tablet package includes a cover, rotatably connected to the bottom portion of the package and provided with an opening which, upon use of the dispenser, is in alignment with the tablet dispensing aperture. The dispenser further includes a locking device to compel joint rotational movement of periodicity indicator and package bottom portion, and an operating member to effect stepwise rotation of the package bottom portion relative to said package cover.

U.S. Pat. No. 5,464,118 to Ulrich Grau and Gunter Ziegert, an apparatus for removing solid medications from blister packs, comprising a shell-shaped bottom part and a hood-shaped top part is provided with an axle. It further exhibits recesses, which are disposed concentrically to the axle. The one end of the axle is configured as a rotational axis and translational guide for the top part. The top part reaches over the bottom part and exhibits a hub, which is supported on the axle by means of a spring. Parallel to the hub on the top part there is a disposed ram, which, given an appropriate setting of the top part relative to the bottom part, is aligned with respectively one of the recesses. The other end of the axle is provided with a journal for receiving a bearing plate for the blister pack. The bearing plate exhibits holes, which form with the recesses of the bottom part passages for the ram.

U.S. Pat. No. 5,562,231 to Lawrence E. Lambelet, Jr. and Henry Passarotti, describes how a substantially circular tablet dispenser component system which may be adapted for a variable day start of a prescribed periodic tablet regimen. Also provided are a tablet dispenser kit, a tablet package adapted for filling the tablet dispenser system, methods of filling the tablet dispenser of the invention and methods of administering a prescribed regimen of medication using the tablet dispenser system of the invention.

U.S. Pat. No. 5,570,810 to Lawrence E. Lambelet, Jr. and Henry Passarotti, describes a substantially circular tablet dispenser component system which may be adapted for a variable day start of a prescribed periodic tablet regimen. Also provided are a tablet dispenser kit, a tablet package adapted for filling the tablet dispenser of the invention and methods of administering a prescribed regimen of medication using the tablet dispenser system of the invention.

U.S. Pat. No. 5,664,697 to Lawrence E. Lambelet, describes a self-actuating dispenser having a base, a pill container, and a means for cyclically indexing the pill container with respect to the base. The base has a pill exit aperture. The pill container, which houses the pills in individual compartments or cells, is movably attached to the base such that any pill cell can be aligned with the pill exit aperture. The pill cells are provided with open bottoms for loading and dispensing which are covered over by the base when attached thereto. The means for cyclically indexing provides that each pill cell in turn is brought into alignment with the pill exit aperture thereby singly dropping the resident pills in a series of dispensing cycles.

Notwithstanding the prior art, the present invention is neither taught nor rendered obvious thereby.

SUMMARY OF THE INVENTION

The present invention is a child resistant rotating disk pill dispenser with a main housing having a top and bottom and an open inside area sufficient to receive a circular pill package and pill package tray for rotation. The main housing has a central shaft for movable connection to the pill package tray. The pill package tray further contains a plurality of annularly arranged pill-drop orifices, and means for receiving and holding in place thereon a circular pill package with a plurality of pills arranged to coincide with the pill-drop orifices. The pill package tray has ratchet means for engagement with a rotating knob for advancement thereof and the rotating-knob is connected to said main housing central shaft so as to be selectively rotatable thereabout and reciprocally movable for a predetermined distance up and down said shaft, with a first vertical position upwardly relative to the pill package tray and a second vertical position downwardly toward the pill package tray, wherein when the knob is in its first vertical position, it is not in rotatable engagement with said ratchet means of said pill package tray, and when said knob is in its second vertical position it is in rotatable engagement there is a dispensing orifice located on the main housing in alignment with a path of rotation of said pill-drop orifices, and a corresponding plunger for pushing pills through a pill package, through a pill-drop orifice and out said dispensing orifice by reciprocal pressure.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
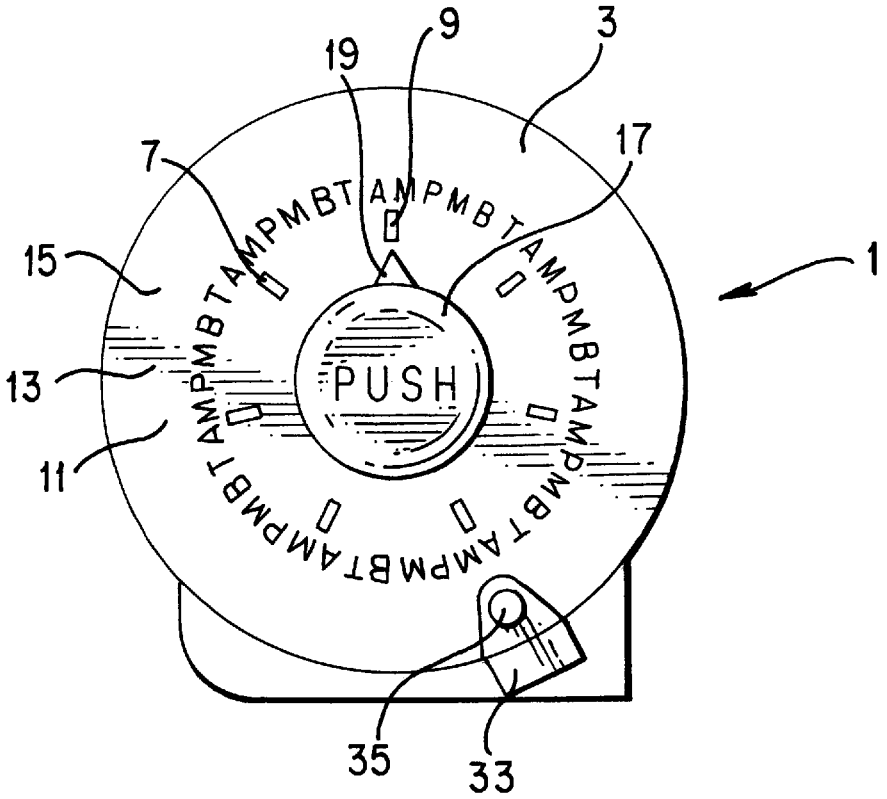
FIG. 1 shows a top view of a preferred embodiment of a child resistant rotating disk pill dispenser.
Figure 2:
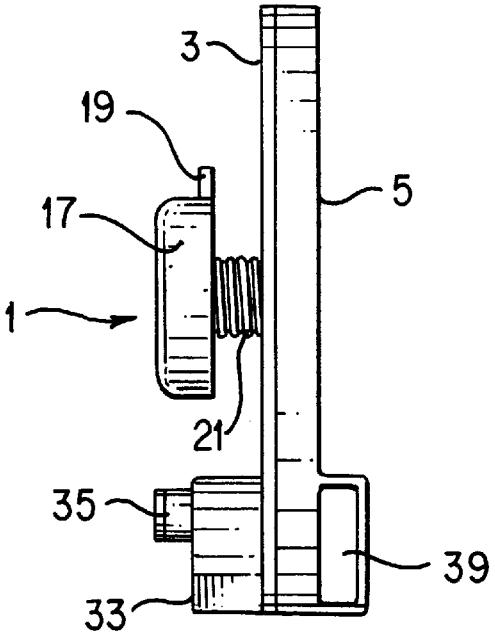
FIG. 2 shows a side view thereof.
Figure 3:
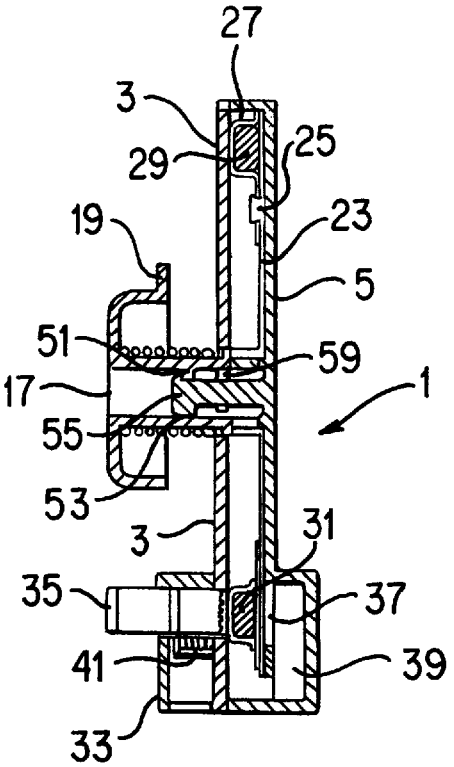
FIG. 3 shows a cut side view thereof.

Referring more specifically to FIGS. 1, 2, and 3, there is shown a top view, a side view, and a cut side view of one preferred embodiment present invention child resistant rotating disk pill dispenser 1, respectively, as shown in those Figures, present invention pill dispenser 1 includes a top 3, and a bottom 5 which together make up a main housing. In this case, top 3 includes chronological indicators such as blocks 7 and 9 which represent sequential twenty four hour days, and, as well, have day segment indicators such as indicators 11, 13, 15 which show "AM", "PM", and "BT", designating morning, afternoon and bedtime and designed for pills which must be taken three times a day. Knob 17 must be pushed down to be rotated and can only be rotated to the next day segment indicator due to stops contained therein which are described below. Knob 17 contains a pointer 19 which acts as an indicator means to correspond to the appropriate indicators located on top 3. Spring 21 acts as a biasing means to maintain knob 17 in a first upward vertical position away from top 3. When knob 17 is pushed downwardly, it will engage with a pill package tray or disk and rotate that tray along with a pill package and this will become more evident regarding the Figures below. FIG. 3 specifically illustrates pill package tray 23 with protrusions such as protrusion 25 which engages and locks onto a pill package tray, a pill package such as pill package 27 containing pills such as pills 29 and 31.

FIGS. 1, 2, and 3 all show a dispensing means 33 which includes a plunger 35 and a dispensing orifice 37 (FIG. 3), as well as an optional chute 39. Referring to FIG. 3, specifically, there is a spring mechanism 41 for biasing plunger 35 in its upward position. When plunger 35 is pressed down it pushes pill 31 through the bottom of pill package 27 and punctures the blister pack so as to push pill 31 through the pill package, through a pill-drop orifice in pill package tray 23 and through dispensing orifice 37 for dispensing out chute 39.

Figure 4:
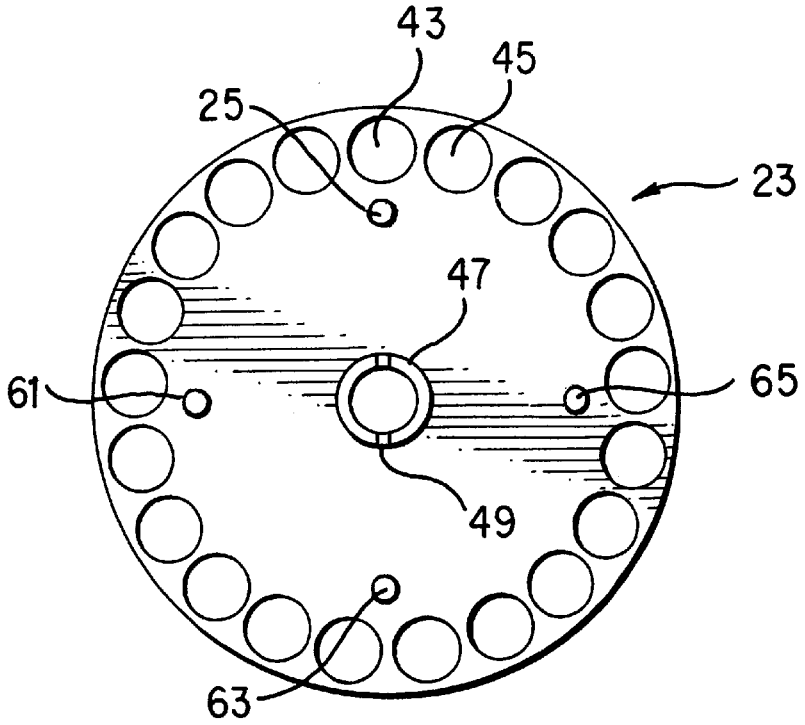
FIGS. 4 and 5 show a top and side view respectively, of a pill package tray utilized in the child resistant rotating disk Dispenser shown in FIG. 1 above.
Figure 5:
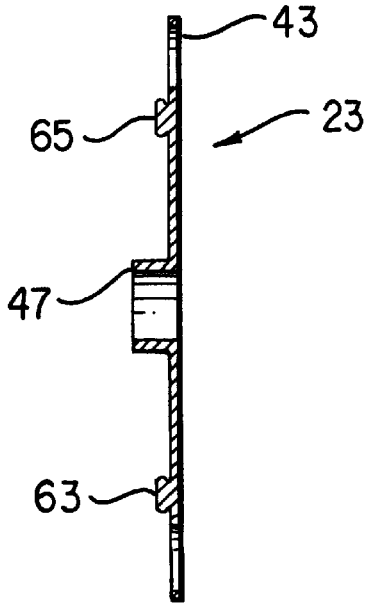
Figure 6:
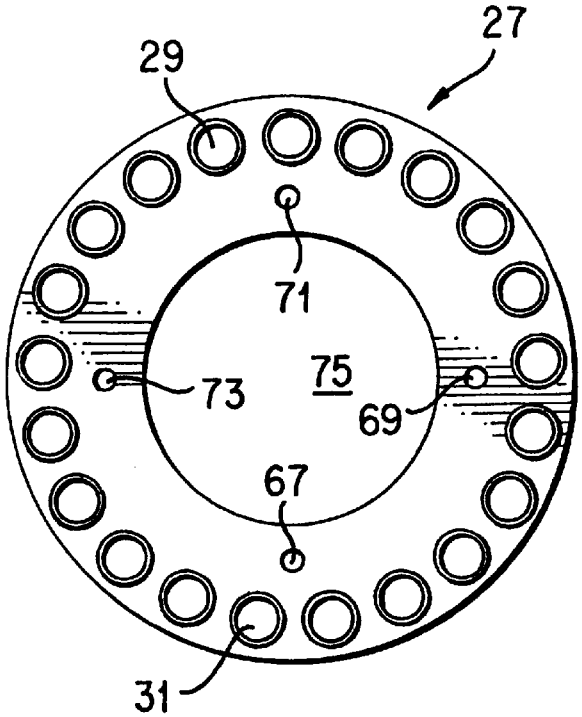
FIGS. 6 and 7 show a top and a side cut view of a pill package which may be used in conjunction with the pill package tray shown in FIGS. 4 and 5.
Figure 7:
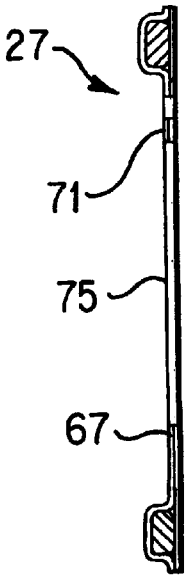

FIG. 4 shows a top view and FIG. 5 shows a side cut view of the pill package tray 23 shown in FIG. 3. It includes a plurality of pilldrop orifices such as pill-drop orifices 43 and 45. In this case there are 21 pill-drop orifices to correspond to total number of day portions for a week (three per day times seven days equalling 21 pill-drop orifices). There is also shown a collar 47 with engagement slots such as slot 49 for engagement with knob 17. Thus, knob 17 may be pressed down to engage pill package tray 23 for rotation thereof. Referring back to FIG. 3, knob 17 contains a plurality of stops such as stop 51 which engages stops located on main housing bottom 5 located such as stop 53 at shaft 55. Thus it can be seen that knob 17 must be pushed downwardly in order to be rotated. Additional stops located at a lower level on shaft 55 such as stop 59 will permit only partial rotation of knob 17 through a cycle which will permit the movement of pill package tray 23 so as to advance to a path of rotation to advance a pill-drop orifice so as to superimpose the position of an adjacent pill-drop orifice to permit dispensing of the next pill. Protrusions such as protrusion 25, 61, 63 and 65 are utilized to engage a pill package such as pill package tray 27 shown in FIGS. 6 and 7 in their top and side cut views. Thus, orifices 67, 69, 71 and 73 correspondingly attach to the aforesaid protrusions of pill package tray 23.

Pill package tray 27 also contains a large central orifice 75 to fit over collar 47 of pill package tray 23 shown in FIGS. 4 and 5. There are 21 pills contained on pill package tray 27 and these correspond directly with the pill-drop orifices of pill package tray 23. In this case, pill package 27 is a blister pack, but the use of a blister pack is not essential to the operability of the present invention. Plunger 35 shown in FIG. 3 may be a solid black or cylinder or could be hollow with a tapered edge or with serrations to enhance ease of piercing when blister packs are used.

Figure 8:
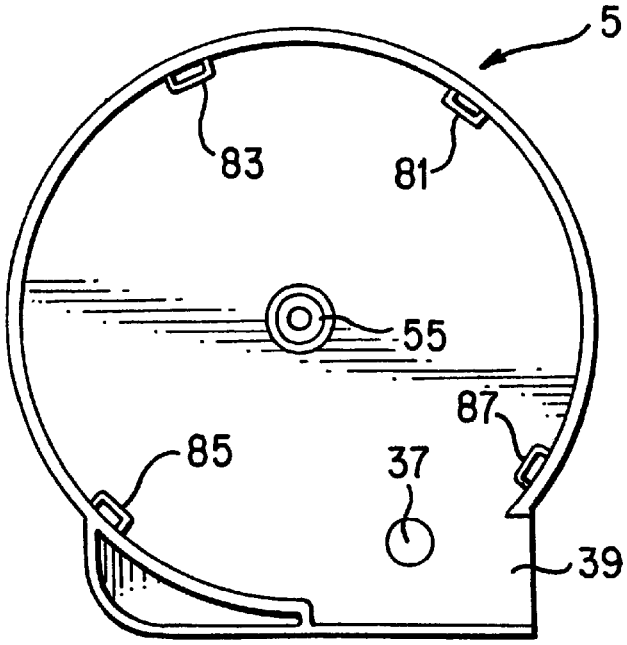
FIG. 8 shows a top view of a bottom segment of the present invention, child resistant rotating disk pill dispenser shown above; and, FIGS. 9 and 10 show a side view and top view, respectively of an alternative embodiment of the present invention pill dispenser.

FIG. 8 shows a top view of bottom 5 of device 1, shown in FIGS. 1 through 3. Identical parts are identically numbered, and repeated here. Additionally, four female U-shaped latching mechanisms 81,83,85 and 87 are shown on the inside wall and are adapted to receive corresponding snap-in male components which would extend from the inside of top 3 of FIGS. 1, 2 and 3 (not shown). This would enable device 1 to be sold with a first pill package contained therein for consumption, wherein the device could be re-opened and snapped together for subsequent use with additional pill packages. Alternatively, top 3 and bottom 5 could be hingedly connected to one another for the same purpose.

Figure 9:
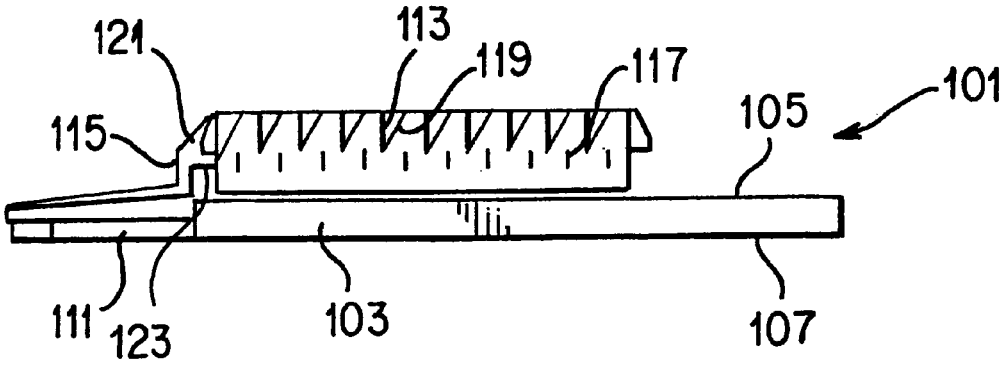
Figure 10:
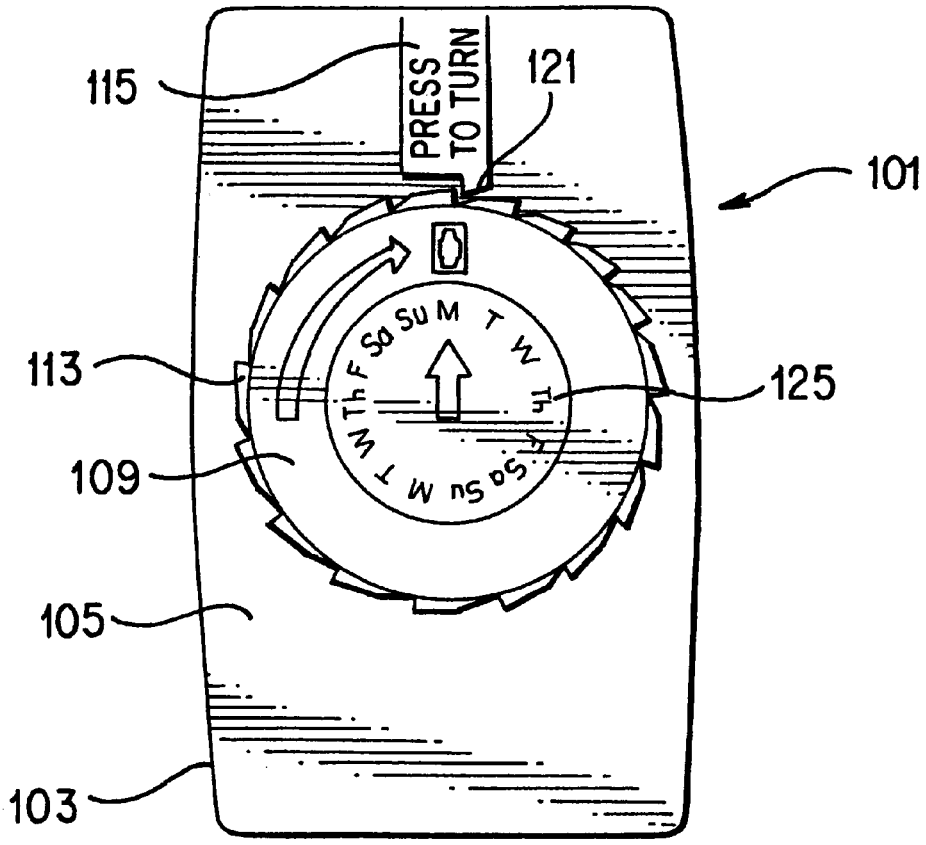

FIG. 9 shows a side view and FIG. 10 shows a top view respectively of an alternative embodiment present invention child resistant pill rotating disk dispenser. More specifically, device 101 contains a main housing 103 which includes a top 105 and a bottom 107. Also, contained thereon is a knob 109 which must be rotated for alignment of a pill for dispensing through dispensing orifice 111. Ratchets such as ratchet 113 located on knob 109 are prevented from rotating by lock-release mechanism 115. Additionally, stops such as stop 117 cooperate with lock-release mechanism 115 to limit movement of knob 109. Ramps such as ramp 119 of ratchet 113 likewise cooperate with lock-release mechanism 115, as follows: lock-release mechanism 115 has a living spring feature which biases it in an upward position so that top point 121 and catch 123 are in an upward first position, as shown. When mechanism 115 is pressed down to its second position, top point 121 moves away from the ratchet to permit rotation of knob 109, while catch 123 permits rotation only until a next stop similar to a stop 117 contacts it. When lock-release mechanism 115 is released, it rises up and top point 121 slides along the ramp of the ratchet to advance the knob 109 to its next firing or dispensing position. This permits a pill to drop out of a disk therein to exit out of dispensing an orifice 111. Chronological indicia such as indicator 125 are included, and an optional plunger for punching through a blister pack may be mounted at an appropriate location on main housing 103, if desired.

Obviously, numerous modifications and variations of the present invention are possible in light of the above teachings. It is therefore understood that within the scope of the appended claims, the invention may be practiced otherwise than as specifically described herein.

What is claimed is:

1. A child resistant rotating disk pill dispenser, which comprises:

(a) a main housing adapted to receive a circular pill package and pill package tray, said main housing having a top and a bottom and having an open inside area sufficient to receive a circular pill package and pill package tray for rotation, said main housing having a central shaft, said central shaft being adapted for movable connection to a pill package tray;

(b) a pill package tray having a central orifice for movable, rotational connection to said central shaft, said orifice being located about said central shaft, said pill package tray further containing a plurality of annularly arranged pill-drop orifices, said pill package tray containing means for receiving and holding in place thereon a circular pill package with a plurality of pills arranged to coincide with said pill-drop orifices, said pill package tray having ratchet means for engagement with a rotating knob for advancement thereof;

(c) a rotating-knob connected to said main housing central shaft so as to be selectively rotatable thereabout and reciprocally movable for a predetermined distance up and down said shaft, said rotating knob having a first vertical position upwardly relative to said pill package tray and a second vertical position downwardly toward said pill package tray, wherein when said knob is in its first vertical position, it is not in rotatable engagement with said ratchet means of said pill package tray, and when said knob is in its second vertical position it is in rotatable engagement with said pill package tray;

(d) a dispensing orifice located on one of said main housing bottom and top, and in alignment with a path of rotation of said pill-drop orifices of said pill package tray, and a corresponding plunger for pushing pills through a pill package, through a pill-drop orifice and out said dispensing orifice by reciprocal pressure, said plunger being located on the other of said main housing top and bottom;

(e) knob biasing means connected to said knob so as to bias same into its first vertical position; and, (f) plunger biasing means connected to said plunger to maintain said plunger in a position away from said pill package tray, except when pressed.

2. The child resistant rotating disk pill dispenser of claim 1, wherein said knob and said central shaft include upper stops which contact with one another to prevent rotation of said knob when in its first vertical position and so as to permit rotation of said knob when in its second vertical position.

3. The child resistant rotating disk pill dispenser of claim 1 wherein said shaft contains a plurality of lower stops thereon which correspond to the number of pill-drop orifices of said pill package tray and arranged so as to stop said knob from rotating further when said knob is pressed and to its second vertical position and rotated and being further arranged so as to stop a pill-drop orifice of said pill package tray when said pill-drop orifice is aligned with said dispensing orifice of said main housing.

4. The child resistant rotating disk pill dispenser of claim 3 wherein said lower stops are not in alignment with said upper stops.

5. The child resistant rotating disk pill dispenser of claim 2 wherein said shaft contains a plurality of lower stops thereon which correspond to the number of pill-drop orifices of said pill package tray and arranged so as to stop said knob from rotating further when said knob is pressed and to its second vertical position and rotated and being further arranged so as to stop a pill-drop orifice of said pill package tray when said pill-drop orifice is aligned with said dispensing orifice of said main housing.

6. The child resistant rotating disk pill dispenser of claim 5 wherein said lower stops are not in alignment with said upper stops.

7. The child resistant rotating disk pill dispenser of claim 1 which further includes chronological indicators located on one of said knob and said main housing, and an indicator means located on the other of said knob and said main housing, said chronological indicators being arranged to correspond to said pill-drop orifices.

8. The child resistant rotating disk pill dispenser of claim 2 which further includes chronological indicators located on one of said knob and said main housing, and an indicator means located on the other of said knob and said main housing, said chronological indicators being arranged to correspond to said pill-drop orifices.

9. The child resistant rotating disk pill dispenser of claim 3 which further includes chronological indicators located on one of said knob and said main housing, and an indicator means located on the other of said knob and said main housing, said chronological indicators being arranged to correspond to said pill-drop orifices.

10. The child resistant rotating disk pill dispenser of claim 1 which further includes a dispensing chute on said main housing and located at said dispensing orifice of said main housing.

11. The child resistant rotating disk pill dispenser of claim 1 wherein said plunger is circular and has a diameter less than a diameter of said pill-drop orifices.

12. The child resistant rotating disk pill dispenser of claim 11 wherein said plunger has a lower end which includes puncture means for puncturing a blister pack-type circular pill package.

13. The child resistant rotating disk pill dispenser of claim 1, wherein said knob shaft includes upper ratchet stops which contact with said lock-release mechanism to prevent rotation of said knob when said lock-release mechanism in its first vertical position and so as to permit rotation of said knob when in its second vertical position.

14. A child resistant rotating disk pill dispenser, which comprises:

(a) a main housing adapted to receive a circular pill package and pill package tray, said main housing having a separate top component and a separate bottom component and having an open inside area sufficient to receive a circular pill package and pill package tray and pill package tray for rotation, said main housing having a central shaft, said central shaft being adapted for movable connection to a pill package tray, said separate top component and bottom component being separably connected to one another so as to permit insertion and removal of circular pill packages;

(b) a pill package tray having a central office for movable, rotational connection to said central shaft, said orifice being located about said central shaft, said pill package tray further containing a plurality of annularly arranged pill-drop orifices, said pill package tray containing means for receiving and holding in place thereon a circular pill package with a plurality of pills arranged to coincide with said pill-drop orifices, said pill package tray having ratchet means for engagement with a rotating knob for advancement thereof;

(c) a rotating-knob connected to said main housing central shaft so as to be selectively rotatable thereabout and reciprocally movable for a predetermined distance up and down said shaft, said rotating knob having a first vertical position upwardly relative to said pill package tray and a second vertical position downwardly toward said pill package tray, wherein when said knob is in its first in vertical position, it is not in rotatable engagement with said ratchet means of said pill package tray, and when said knob is in its second vertical position it is in rotatable engagement with said pill package tray;

(d) a dispensing orifice located on one of said main housing bottom and top, and in alignment with a path of rotation of said pill-drop orifices of said pill package tray, and a corresponding plunger for pushing pills through a pill package, through a pill-drop orifice and out said dispensing orifice by reciprocal pressure, said plunger being located on the other of said main housing top and bottom;

(e) knob biasing means connected to said knob so as to bias same into its first vertical position; and, (f) plunger biasing means connected to said plunger to maintain said plunger in a position away from said pill package tray, except when pressed.

15. The child resistant rotating disk pill dispenser of claim 14, wherein said knob and said central shaft include upper stops which contact with one another to prevent rotation of said knob when in its first vertical position and so as to permit rotation of said knob when in its second vertical position.

16. The child resistant rotating disk pill dispenser of claim 14 wherein said shaft contains a plurality of lower stops thereon which correspond to the number of pill-drop orifices of said pill package tray and arranged so as to stop said knob from rotating further when said knob is pressed and to its second vertical position and rotated and being further arranged so as to stop a pill-drop orifice of said pill package tray when said pill-drop orifice is aligned with said dispensing orifice of said main housing.

17. The child resistant rotating disk pill dispenser of claim 16, wherein said lower stops are not in alignment with said upper stops.

18. The child resistant rotating disk pill dispenser of claim 14 which further includes chronological indicators located on one of said knob and said main housing, and an indicator means located on the other of said knob and said main housing, said chronological indicators being arranged to correspond to said pill-drop orifices.

19. A child resistant rotating disk pill dispenser, which comprises:

(a) a main housing adapted to receive a circular pill package and pill package tray, said main housing having a top and a bottom and having an open inside area sufficient to receive a circular pill package and pill package tray for rotation, said main housing having a central shaft, said central shaft being adapted for movable connection to a pill package tray;

(b) a pill package tray having a central orifice for movable, rotational connection to said central shaft, said orifice being located about said central shaft, said pill package tray further containing a plurality of annularly arranged pill-drop orifices, said pill package tray containing means for receiving and holding in place thereon a circular pill package with a plurality of pills arranged to coincide with said pill-drop orifices, said pill package tray having ratchet means for engagement with a rotating knob for advancement thereof;

(c) a rotating-knob connected to said main housing central shaft so as to be selectively rotatable thereabout and a separate lock-release mechanism reciprocally movable for a predetermined distance up and down for locking and releasing said knob for rotational movement, said knob having sequential stops corresponding to said pill package tray pill-drop orifices, said mechanism having a first position upwardly and a second vertical position downwardly relative to said pill package tray, wherein when said mechanism is in one of its first vertical position and its second vertical position, it is not in engagement with said knob stops, and when said mechanism is in the other of its first vertical position and its second vertical position it is in engagement with said knob-stops;

(d) a dispensing orifice located on one of said main housing bottom and top, and in alignment with a path of rotation of said pill-drop orifices of said pill package tray; and, (e) lock-release mechanism biasing means connected to said mechanism so as to bias same into its first vertical position.

20. The child resistant rotating disk pill dispenser of claim 19 wherein said plunger has a lower end which includes puncture means for puncturing a blister pack-type circular pill package.

* * * * *